US005570598A

United States Patent [19]

Haven

[11] Patent Number: 5,570,598

[45] Date of Patent: Nov. 5, 1996

[54] COUNTER TOP CLOTHES WASHER

[76] Inventor: Lonnie M. Haven, 5600 Poinsettia Ave., West Palm Beach, Fla. 33407

[21] Appl. No.: 393,930

[22] Filed: Feb. 21, 1995

[51] Int. Cl.[6] ..... D06F 3/02

[52] U.S. Cl. ..... 68/22 A; 68/233; 68/99; 68/235 D; 68/228

[58] Field of Search ..... 68/22 A, 245, 68/226, 228, 335, 99, 22 R, 235 D, 248; 366/251, 282, 283

[56] References Cited

U.S. PATENT DOCUMENTS

| | | | |
|---|---|---|---|
| 2,174,787 | 10/1939 | Holland | 68/22 A |
| 2,272,030 | 2/1942 | Benson | 68/122 |
| 2,315,604 | 4/1943 | Ebert | 68/132 |
| 2,315,684 | 4/1943 | Benson | 68/122 |
| 2,430,769 | 11/1947 | Hutchinson | 68/233 |
| 2,493,916 | 1/1950 | Gibson | 68/22 A |
| 2,523,165 | 9/1950 | Tice | 68/22 A |
| 2,732,700 | 1/1956 | Dunn | 68/233 |
| 2,756,580 | 7/1956 | Castner | 68/22 A |
| 2,903,873 | 9/1959 | Brogdon | 68/3 |
| 3,085,583 | 4/1963 | Siek | 134/92 |
| 3,277,675 | 10/1966 | Scott | 68/156 |
| 3,318,119 | 5/1967 | Barks | 68/208 |
| 3,320,779 | 5/1967 | Kent | 68/51 |
| 4,522,045 | 1/1985 | Harada | 68/22 A |

*Primary Examiner*—Frankie L. Stinson
*Attorney, Agent, or Firm*—Joseph H. McGlynn

[57] ABSTRACT

A portable washing machine designed to fit onto conventional sized pots that can be found in any kitchen. The portable washing machine has a motor attached to an agitator which can be detachable from the motor and hand operated rollers for removing excess water from clothes and a smooth, uneven surface for scrubbing clothes at the bottom of which is a drain hole which allows excess water to return to the pot.

5 Claims, 1 Drawing Sheet

COUNTER TOP CLOTHES WASHER

BACKGROUND OF THE INVENTION

This invention relates in general to washing machines and in particular to small, portable, counter top washing machines.

DESCRIPTION OF THE PRIOR ART

In the prior art small, portable washing machines have been known, however the prior art machines have been designed to be used with a tub that was designed especially for the particular washing machine. This caused problems for people who lived in small apartments, mobile homes or who used recreational vehicles. Since storage space is at a premium in apartments, mobile homes or recreational vehicles, the washing machine used up too much storage space. Consequently, some people had to forego the convenience of a washing machine and instead were forced to rely on hand washing or a Laundromat.

SUMMARY OF THE INVENTION

This invention is designed to overcome the above disadvantages. The washing machine of the present invention is designed so all the components of the washing machine are placed in the cover or lid. The cover or lid is designed to fit onto conventional sized pots that can be found in any kitchen so only additional storage for the lid or cover must be found. The pot or tub that the lid or cover will be used with will already be in the kitchen of most apartments, mobile homes or recreational vehicles.

It is an object of the present invention to provide a small, compact washing machine that will fit comfortably in a small apartment, mobile home or recreational vehicle.

It is an object of the present invention to provide a small, compact washing machine that will not need a special pot or tub.

It is an object of the present invention to provide a small, compact washing machine that has all the components of the washing machine mounted in the lid or cover.

These and other objects and advantages of the present invention will be fully apparent from the following description, when taken in connection with the annexed drawings.

DESCRIPTION OF THE PREFERRED EMBODIMENT

Figure 1:
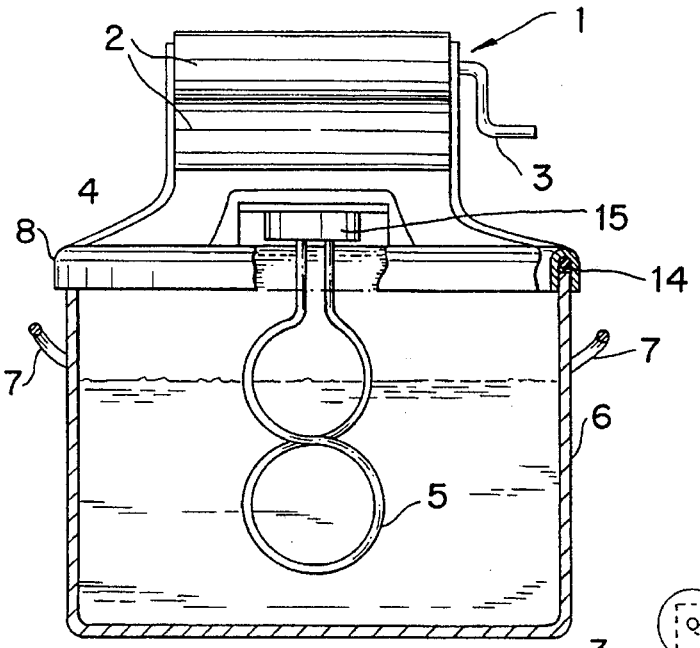
FIG. 1 is a cross-sectional view of the present invention.
Figure 4:
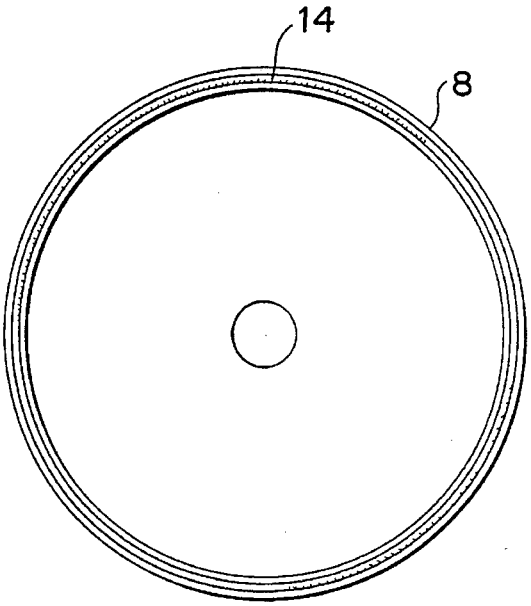
FIG. 4 is a view of the underside of the lid showing the O-ring seal.

FIG. 1 shows the present invention 1 mounted on a cooking pot or tub 6 having handles 7. The washing machine 1 has a curved lip 8 which fits onto the top of the pot or tub 6. Inside the curved lip 8 is an O-ring 14 (see FIG. 4) which is compressed between the washing machine and the top of the pot or tub. The O-ring could be compressed by the weight of the washing machine lid or cover, or optionally, catches could be provided which would engage the handles 7, or some other part of the pot to compress the seal 14 in order to prevent water escaping from inside the pot or tub. The lid could also be provided with conventional safety switches (not shown) so the motor will not run unless the lid is closed on a pot or tub.

The washing machine 1 is also provided with an agitator 5 which is rotated by a sealed electric motor 15. The motor could be mounted inside the lid or cover or it could be mounted under the lid or cover. Since the motor is sealed there is no problem with water coming in contact with the motor. The agitator would have a releasable connection with the motor in a manner similar to the connection between a food mixer and its beaters, and a release catch for the agitator could be mounted on the outside of the lid. The releasable connection is to make the washing machine easier to store, however, if storage is not a problem, the agitator could be permanently attached to the motor without departing from the spirit of the invention.

A handle 4 is attached to the top of the washing machine to make it easier to remove the washing machine from the pot or tub 6. Also attached to the top of the washing machine is a pair of rollers 2, at least one of which can be rotated by a hand crank 3. The crank could be made removable from the roller by providing the end of the crank with a rectangular end which fits into a rectangular socket on the roller. The rollers are used to wring excess water from the clothes after they are washed.

Figure 2:
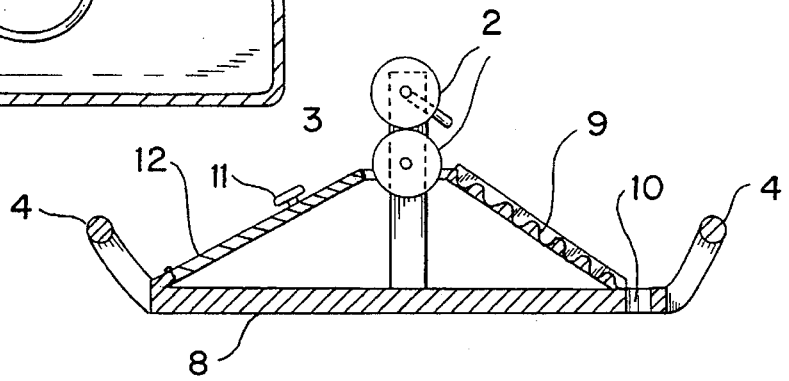
FIG. 2 is a side view of the present invention.
Figure 3:
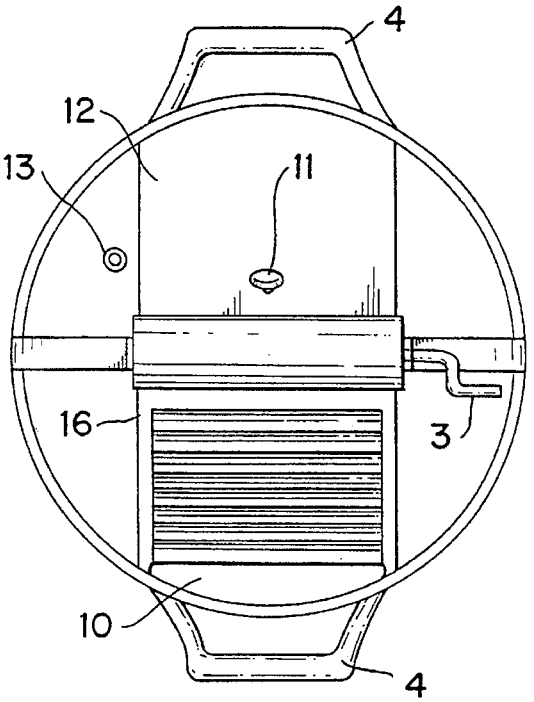
FIG. 3 is a top view of the present invention.

FIG. 2 is a side view of the washing machine showing important aspects of the invention that can not be seen in FIG. 1. Mounted on the top surface of the washing machine, just beneath the rollers 2, is an undulating surface 9 which can be made as a smooth, corrugated surface or can be made as a series of smooth bumps. This surface can be used to scrub particularly dirty clothes, either before they are washed in the machine or after they are washed. Water used to scrub clothes on the surface 9 will drain through drain hole or slot 10, and then fall into pot or tub 6. Since water is designed to flow into the drain 10, there must be passageways between the rows of undulations to allow water to flow into the drain. In the case of the surface being made from a series of smooth bumps this will not be a problem since the individual bumps will inherently provide passageways between each bump. If the surface is made as rows of undulations, there should be passageways between the rows to allow water to flow into the drain 10. Also, there should be a ridge 16 (see FIG. 3) around the perimeter of this surface to catch excess water and prevent the water from flowing onto the floor.

On the other side of the rollers 2 from the undulating surface 9 is a small door 12 hinged at 17 (see FIG. 2) to the top of the washing machine lid which can be opened by pulling up on knob 11. This door can be used to put clothes into the washing machine, or it can be used to put detergents or other laundry cleaners into the machine. The door could have a conventional catch (not shown) to hold the door closed when the washing machine is in use, to prevent water from escaping from inside the machine. The door should also be equipped with a conventional safety switch (not shown) so the motor will not run unless the door is closed. The door 12 could be made from a transparent material so the user could see inside the washing machine. The door could also be provided, on its underside, with a seal similar to the seal 14 (shown in FIG. 4) to keep water from coming out of the machine.

On top of the washing machine control knob 13 could be provided to adjust the speed of the motor. For example the motor could have two speeds, normal which is really a gentle, moderate speed and slow. The various speeds would be used depending on the type of clothes being washed. The speed control would be a conventional switch which would be rotated to the proper setting to select whichever motor speed is desired. Any number of speeds could be provided, although it is anticipated that only two speeds would be needed.

Although the washing machine and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A portable washing machine comprising: a lid adapted to fit on a pot or tub, said lid having attached thereto agitator means for moving clothes within water in said pot or tub, a motor for turning said agitator, roller means mounted above said lid for removing excess water from clothes, and a scrubbing surface positioned on said lid, said scrubbing surface being smooth and non-even, said lid having an apex, said roller means being mounted at said apex, and said scrubbing surface comprising a plurality of ridges and grooves, said ridges extending parallel to said roller means.

2. The portable washing machine of claim 1, in which a crank is attached to at least one of said roller means for turning said at least one of said roller means.

3. The portable washing machine of claim 2, in which said crank is detachably attached to said at least one of said roller means.

4. The portable washing machine of claim 1, wherein a seal is attached around the perimeter of said lid.

5. The portable washing machine of claim 1, wherein an aperture is provided in said lid on the side opposite said scrubbing surface, and a door is attached to said lid for closing said aperture.

* * * * *